US006559740B1

(12) United States Patent
Schulz et al.

(10) Patent No.: US 6,559,740 B1
(45) Date of Patent: May 6, 2003

(54) TUNABLE, CROSS-COUPLED, BANDPASS FILTER

(75) Inventors: Ryan E. Schulz, Thousand Oaks, CA (US); Daniel R. Bowler, Simi Valley, CA (US)

(73) Assignee: Delta Microwave, Inc., Oxnard, CA (US)

( * ) Notice: Subject to any disclaimer, the term of this patent is extended or adjusted under 35 U.S.C. 154(b) by 0 days.

(21) Appl. No.: 10/020,824

(22) Filed: Dec. 18, 2001

(51) Int. Cl.[7] ..... H01P 1/201
(52) U.S. Cl. ..... 333/202; 333/203; 333/212
(58) Field of Search ..... 333/202, 134, 333/203, 212, 230, 208, 207, 206, 209

(56) References Cited

U.S. PATENT DOCUMENTS

| | | | | | |
|---|---|---|---|---|---|
| 4,037,182 | A | | 7/1977 | Burnett et al. | |
| 4,216,448 | A | * | 8/1980 | Kasuga et al. | 333/203 |
| 4,224,587 | A | | 9/1980 | Makimoto | |
| 4,275,369 | A | | 6/1981 | Sekiguchi | |
| 4,307,357 | A | | 12/1981 | Alm | |
| 4,320,368 | A | | 3/1982 | Sekiguchi | |
| 4,410,868 | A | | 10/1983 | Meguro et al. | |
| 4,459,570 | A | | 7/1984 | Delaballe et al. | |
| 4,568,895 | A | | 2/1986 | Reed | |
| 4,626,809 | A | | 12/1986 | Mizumura et al. | |
| 4,692,727 | A | | 9/1987 | Wakino et al. | |
| 4,721,933 | A | | 1/1988 | Schwartz et al. | |
| 4,757,289 | A | | 7/1988 | Kosugi et al. | |
| 4,890,078 | A | | 12/1989 | Radcliffe | |
| 4,980,662 | A | * | 12/1990 | Simon et al. | 333/134 |
| 5,608,363 | A | * | 3/1997 | Cameron et al. | 333/202 |
| 5,684,438 | A | * | 11/1997 | Cavalieri D'Oro et al. | 333/202 |
| 5,748,058 | A | | 5/1998 | Scott | |
| 5,760,667 | A | | 6/1998 | Young et al. | |
| 5,777,534 | A | | 7/1998 | Harrison | |
| 5,781,085 | A | | 7/1998 | Harrison | |
| 5,841,330 | A | | 11/1998 | Wenzel et al. | |
| 6,025,764 | A | * | 2/2000 | Pelz et al. | 333/134 |
| 6,037,541 | A | | 3/2000 | Bartley et al. | |
| 6,208,221 | B1 | * | 3/2001 | Pelz et al. | 333/126 |
| 6,304,160 | B1 | * | 10/2001 | Loi et al. | 333/202 |
| 6,329,889 | B1 | * | 12/2001 | Puoskari | 333/202 |

* cited by examiner

*Primary Examiner*—Seungsook Ham
(74) *Attorney, Agent, or Firm*—Jack C. Munro

(57) ABSTRACT

A cross-coupled bandpass filter for a microwave electromagnetic signal which utilizes a housing which has formed therein a plurality of sequentially located resonator cavities with these cavities being interconnected by in-line couplers. A resonator is mounted within each cavity. A cross-coupler is disposed between a pair of the cavities that are not sequentially located. The cross-coupler takes the form of a printed circuit board upon which are mounted at least one manually movable screw access to which is permitted exteriorly of the cavities.

6 Claims, 2 Drawing Sheets

TUNABLE, CROSS-COUPLED, BANDPASS FILTER

BACKGROUND OF THE INVENTION

1. Field of the Invention

The present invention relates generally to the field of microwave filters and more particularly to a bandpass filter which is to be used in microwave communication systems, such as cellular phones, cellular phone base stations, satellites and the like.

2. Description of the Related Art

In the microwave communications market, the microwave frequency spectrum has become severely crowded and has been subdivided into a vast number of different frequency bands. There is a need to design microwave filters that have an output signal only at a precise (narrow) frequency band. Also, it is necessary that this filter can be tuned to a precise frequency band with there being a separate filter for each precise frequency band.

In the field of microwave bandpass filters, it is known that the frequency band of the signal of the filter is a function of the resonant frequency of resonators that are incorporated within the filter and respective coupling coefficients between each of these resonators. Typically, in order to achieve a specific precise bandwidth, the resonators are longitudinally spaced in a sequential manner. The bandwidth is a function of the coupling between the resonators and the frequency of the resonance of the resonators. Varying of the spacing between the resonators results in variations in the bandwidth. Accordingly, overall filter dimensions, such as the filter length, typically must be varied in order to tune a filter to a precise bandwidth. Therefore, in the past in order to divide a microwave communications band into the many different frequency bands of operation, a multitude of different filter dimensions are necessary. However, because there is a need to minimize the size of such filters, and the fact that such filters may be located in very remote locations, such as satellites, a non-uniform filter dimension is just not acceptable.

The constructing of a filter that can be tuned to a selected microwave frequency has long been known. It has been discovered that if there is included in the filter a cross-coupler that connects between a pair of non-sequential resonators, a variation in the response of the filter is obtained. A slight position variation of that cross-coupler will result in a mismatch of the microwave signal inside the filter. Therefore, changing the position of the cross-coupler can produce filters that more or less mismatched depending on cross-coupler coupling valve.

A typical cross-coupler constitutes an electrically conductive wire like member with a small plate being fixedly mounted at each end of the member. The member is then mounted across a vertical wall located in the filter that separates two of the non-sequential resonating cavities. The filter is covered by a removable cover. A technician whom has been instructed to produce a filter at a precise frequency, connects the filter to a piece of test equipment. If the coupling is not at the precise value, then the technician is to remove the cover, manually alter the position of one end or both ends of the wire type member cross-coupler, then replace the cover in position on the housing of the filter and then retest to determine if the coupling value is correct. If it is not the desired specific value, then the adjustment procedure is performed again and continues until the desired coupling is obtained. At times, it can literally take hours for a filter to be tuned to the precise coupling value because of the time involved in removing of the cover and reinstalling same.

SUMMARY OF THE INVENTION

The first embodiment of the present invention is to construct a tunable, cross-coupled bandpass filter which is formed of an enclosing housing which has a plurality of sequentially located resonator cavities. An input port is connected to a beginning cavity and an outlet port is connected to an ending cavity. A resonator is mounted within each of the resonator cavities. Each of the resonator cavities have an in-line coupler for coupling the electromagnetic signal between each sequential pair of resonators. A cross-coupler is disposed between a pair of non-sequential cavities. The cross-coupler includes a printed circuit (PC) board.

A further embodiment of the present invention is where the first basic embodiment is modified by the cavities being divided into a pair of side-by-side rows.

A further embodiment of the present invention is where the first basic embodiment is modified by there being located a vertical wall between at least two in number of the cavities that are not in direct sequence.

A further embodiment of the present invention is where the first basic embodiment is modified by each of the cavities being of a square shape in transverse cross-section.

A further embodiment of the present invention is where the first basic embodiment is modified by each resonator being cylindrical.

A further embodiment of the present invention is where the first basic embodiment is modified by the PC board including a dielectric compression board.

A further embodiment of the present invention is where the first basic embodiment is modified by the PC board being formed of a dielectric layer and an electrically conductive layer.

A further embodiment of the present invention is where the first basic embodiment is modified by the PC board including at least one tuning screw passing through a hole in the PC board.

However, it is important that the copper layer 74 form edge layers at each longitudinal end of the fiberglass layer 72 such as edge layer 75. Edge layer 75 will alter the inductance of the magnetic field passing through the filter 10 by the close proximity of each edge layer 75 to a resonator 28. Each edge layer 75 covers the edge of fiberglass layer 72 but not the edge of the compression board 66.

A further embodiment of the present invention is where the first basic embodiment is modified by a cover being mounted on the housing of the filter with the cover being removable.

A second basic embodiment of the present invention comprises a cross-coupled bandpass filter for a microwave electromagnetic signal which takes the form of an enclosing housing that has a plurality of resonator cavities located in a sequential arrangement. Directly between each pair of cavities in sequence there is located an in-line coupler. A resonator is located within each of the cavities. A cross-coupler is disposed between a pair of the cavities that are not in sequence with a first portion of the cross-coupler being located within one cavity and a second portion of the cross-coupler being located within another cavity. A cross-coupler is mounted between those cavities with the cross-coupler including a tuning screw that is manually turnable relative to the cross-coupler.

A further embodiment of the present invention is where the second basic embodiment is modified by the cavities being located in a pair of side-by-side rows.

A further embodiment of the present invention is where the second basic embodiment is modified by there being a vertical wall located between a pair of cavities which are not in direct sequence.

A further embodiment of the present invention is where the second basic embodiment is modified by the resonator cavities each being formed square in transverse cross-section.

A further embodiment of the present invention is where the second basic embodiment is modified by each resonator that is mounted within each cavity being cylindrical.

A further embodiment of the present invention is where the second basic embodiment is modified by the cross-coupler including a PC board which is formed by a dielectric layer and an electrically conductive layer.

A further embodiment of the present invention is where the second basic embodiment is modified by the tuning screw being mounted in conjunction with the PC board.

A further embodiment of the present invention is where the second basic embodiment is modified by there being a pair of tuning screws mounted in conjunction with the PC board with these tuning screws being located in a spaced apart arrangement.

A further embodiment of the present invention is where the second basic embodiment is modified by there being mounted a removable cover in conjunction with the housing with the tuning screws protruding exteriorly of the cover.

A further embodiment of the present invention is where the second basic embodiment is modified by the cover being spaced from both the electrically conductive layer and the resonators.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
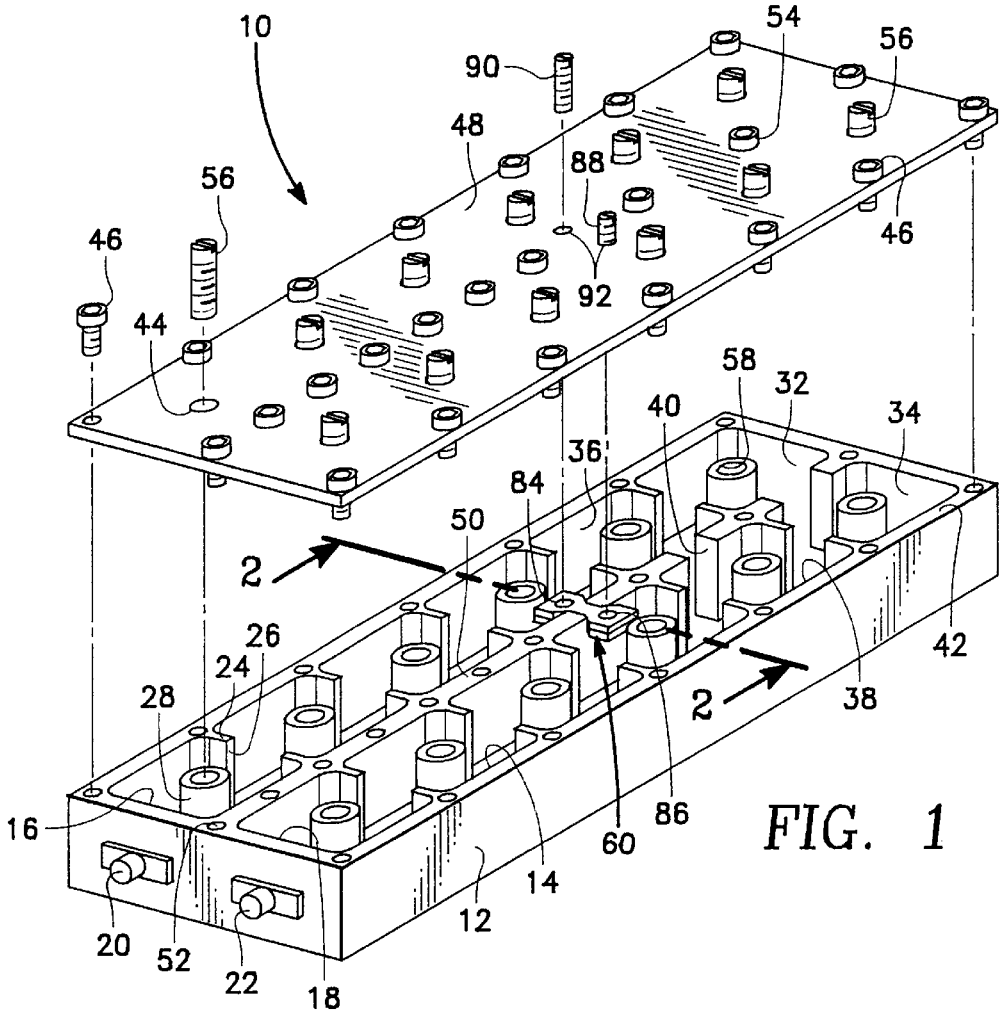
FIG. 1 is an isometric view of the bandpass filter of the present invention showing the cover of the bandpass filter being located in.a disengaged position from the housing.
Figure 2:
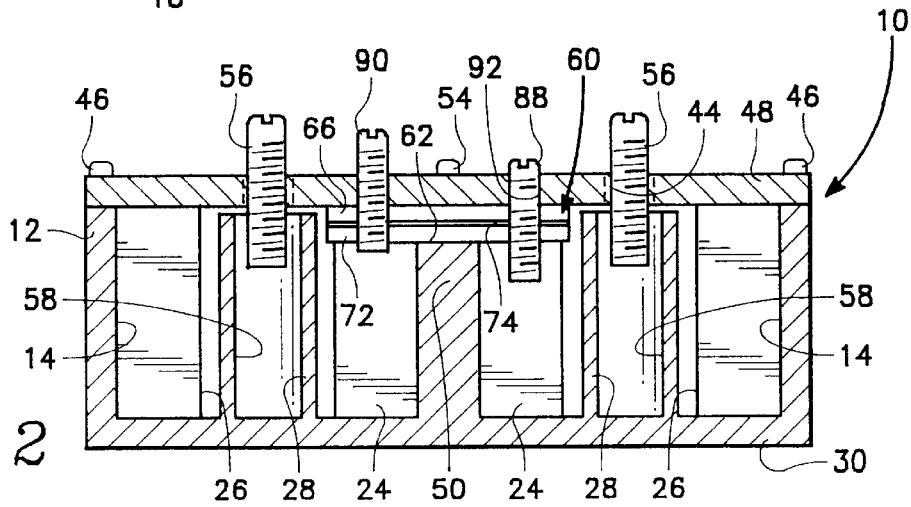
FIG. 2 is transverse cross-sectional view taken along line 2—2 of FIG. 1 through the housing of the filter of the present invention showing the cover mounted on the housing.
Figure 3:
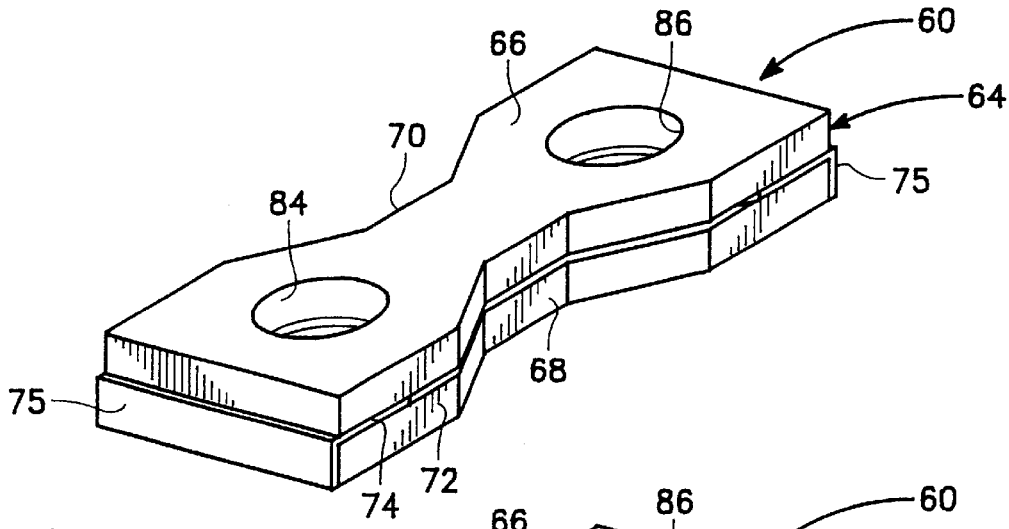
FIG. 3 is an isometric view of the cross-coupler that is usable in conjunction with the bandpass filter of the present invention.
Figure 4:
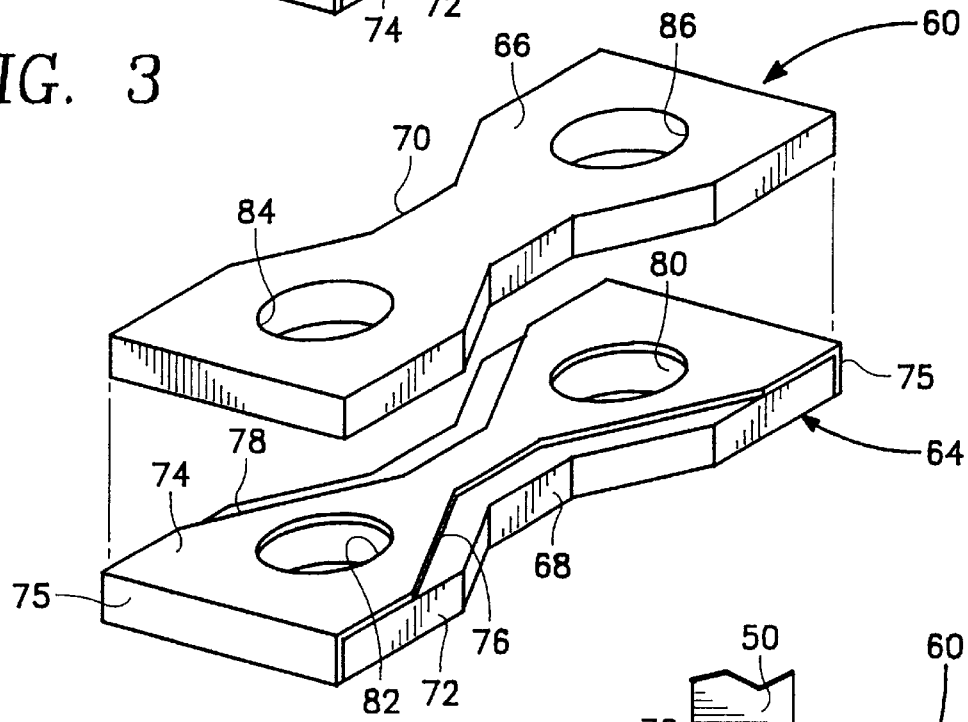
FIG. 4 is an exploded isometric view of FIG. 3 showing the compression board removed and spaced from the printed circuit board of the cross-coupler.
Figure 5:
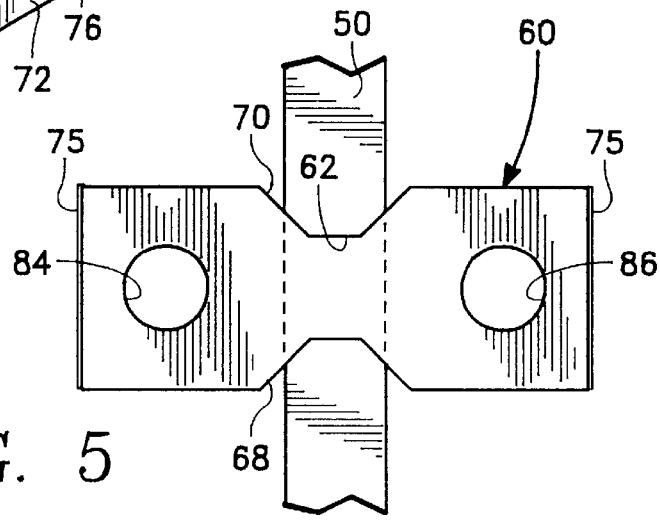
FIG. 5 is a plan view of the cross-coupler included within the bandpass filter of the present invention.

Referring particularly to the drawings, there is shown in FIG. 1 a tunable, cross-coupled, bandpass filter 10. The filter 10 utilizes a rectangularly shaped housing 12 which has an internal chamber which is divided into a plurality of cavities 14. Preferable material of construction for housing 12 would be aluminum. The cavities 14 include a beginning cavity 16 and an ending cavity 18. Each cavity 14, 16 and 18 is basically of the same size. In transverse cross-section, each cavity 14, 16 and 18 is basically square in configuration. However, it is considered to be within the scope of this invention that other shapes for the cavities 14, 16 and 18 could be utilized. Connecting with the beginning cavity 16 is an input port 20. An output port 22 connects with the ending cavity 18.

Between the beginning cavity 16 and the directly adjacent cavity 14 there is an iris in the form of a partial wall 24. The partial wall 24 includes an opening 26. The opening 26 functions as an in-line coupler for the electromagnetic signal which is being transmitted through the input port 20 into the beginning cavity 16 and into directly adjacent cavity 14. Mounted within the beginning cavity 16 is a resonator 28 which is in the form of an aluminum cylindrical tube. The resonator 28 is centrally located within the cavity 16 and extends from the bottom wall 30 of the housing 12. It is to be understood that each cavity 14 has a similar partial wall 24 and a similar opening 26 and also a similar resonator 28.

The cavities 14 that are located furthest from the input port 20 and the output port 22 are known as the corner cavities 32 and 34. Located directly adjacent the corner cavities 32 are a pair of connecting cavities 36 and 38. In between the connecting cavities 36 and 38 is a bridge coupler in the form of an opening 40. There is also an opening 26 that connects between corner cavity 34 and connecting cavity 38. In other words, the electromagnetic signal is being transmitted through both the inline coupler of opening 26 and the bridge coupler of opening 40 prior to transmittal through the remaining cavities 14 to the ending cavity 18 and out through the outlet port 22.

Planar upper edge 42 of the housing 12 includes a mass of spaced apart threaded holes 44. Threaded holes 44 are to be engageable with threaded bolts 46 which are mounted within a planar cover 48. The cover 48 is to be tightly sealed onto the housing 12 so that the cavities 14 are completely closed relative to ambient. It is to be noted that the cavities 14 within the housing 12 is formed in essence into one row and a second row which is parallel to the first row. Separating these rows is a vertical wall 50. The vertical wall 50 also includes a series of threaded holes 52 with which there is mounted in the cover 48 a series of threaded bolts 54 which threadably connect with the holes 52.

Threadably mounted within the cover 48 are a plurality of threaded set screws 56. Each set screw 56 is to be locatable within the internal chamber 58 of a resonator 28. Therefore, there is a threaded set screw 56 for each resonator 28. However, there may not be utilized set screw 56 for each resonator 28 with only some resonators 28 having a set screw. The threaded set screws 56 can be manually adjusted in order to vary the frequency of the electromagnet signal being received at the outlet port 22. Generally, the set screws 56 will be turned so that the frequency of the signal being emitted from the outlet port 22 is close to the precise frequency that is desired. Then to achieve the exact frequency, there is used the cross-coupler 60. The cross-coupler 60 is fixedly mounted as with adhesive within a chamfered recess 62 formed within the vertical wall 50. The chamfered recess 62 connects between two cavities 14 that are not directly in sequence. The cross-coupler 60 is to be constructed of a PC board 64 and a compression board 66. The cross-coupler 60 has a pair of inward cuts 68 and 70 which matingly connect with the chamfered recess 62 formed within the vertical wall 50. This means that the cross-coupler 60 is fixedly positioned in a precise position on the vertical wall 50.

The printed circuit board 64 is formed of a fiberglass layer 72 upon which is adhered an electrically conducting layer 74. The fiberglass layer 72 is dielectric and the conducting layer 74 could be of copper or other suitable metallic electrically conductive substance. Generally, the thickness of the layer 74 would be 1.4 mils. The cross-coupler 60 has a "bow tie" configuration due to the forming of an inward cut 68 and 70. The layer 74 also includes inner cuts 76 and 78 which are spaced respectively from the inward cuts 68 and 70. This is so that the copper layer 74 will not physically come into contact with the wall 50 which may affect the transmitting of the electromagnetic signal. However, it is important that the copper layer 74 form edge layers at each longitudinal end of the fiberglass layer 72 such as edge layer 75. Edge layer 75 will alter the inductance of the magnetic field passing through the filter 10 by the close proximity of each edge layer 75 to a resonator 78. Each edge layer 75 covers the edge of fiberglass layer 72 but not the edge of the compression board 66.

Formed within the copper layer 74 and the fiberglass layer 72 are a pair of holes 80 and 82. Formed within the compression board 66 are a similar pair of holes 84 and 86. Hole 86 is to align with hole 80 and hole 84 aligns with hole 82. All holes 80, 82, 84 and 86 are of the same size. A tuning screw 88 is to be mounted within the cover 48 and is to be located within the aligned holes 80 and 86. A similar tuning screw 90 is to be mounted within the cover 48 and is to be located within aligned holes 82 and 84. Both the tuning screws 88 and 90 are to be in physical contact with the copper layer 74. The function of the compression board 66 is to keep the PC board 64 spaced from the cover 54 with this spacing occurring by means of a dielectric with the general material of construction for the compression board 66 also being fiberglass. It is also to be noted that the free end of each of the resonators 28 is of a length so that it will be spaced from the cover 48. The spacing of the PC board 64 from the cover 48 and the spacing of each of the resonators 28 from the cover 48 is to insure the maximum transmission of energy of the electromagnetic signal from the input port 20 to the output port 22 over operating temperatures.

With the filter 10 of this invention connected to a piece of test equipment, which is not shown, such as an network. analyzer, the frequency of the signal being emitted from the output port 22 is ascertained. To fine tune that frequency, the technician can manually adjust the position of the screws 88 and 90 relative to the cross-coupler 60. Once the desired precise frequency is obtained, the position of the screws 88 and 90 is maintained as well as each-of the screws 56. The filter 10 is then ready for installation. It is important to note that by utilizing of the screws 56, 88 and 90 that tuning of the filter 10 is accomplished without removal of the cover 48 from the housing 12. Obviously, by the sheer number of the threaded bolts 46 and 54, it would constitute a rather time consuming procedure to be constantly removing of the cover 48 and replacing the cover 48 in order to achieve tuning of the filter 10. This removal of the cover 48 has been eliminated. By using of the cross-coupler 60, a precise frequency can be obtained for each filter 10. It is to be understood that in a given installation there will generally be only one filter 10 for a precise frequency. A typical satellite will have installed several hundred of the filters 10. It is to be understood that the turning of tuning screws 88 and 90 is accomplished individually as well as the turning of the set screws 56. Tuning screws 88 and 90 function to interrupt the magnetic field passing through the trace copper layer 74 which changes the overall susceptance of the electromagnetic field that is being conducted through the filter 10.

What is claimed is:

1. A tunable, cross-coupled, bandpass filter comprising:

a housing having a plurality of sequential resonator cavities which start with a beginning cavity and end with an ending cavity, an input port connected to said housing which is to transmit an electromagnetic signal into said beginning cavity, an outlet port connected to said housing which is to receive from said ending cavity a filtered electromagnetic signal which has matured from said electromagnetic signal;

a resonator mounted within each of said resonator cavities;

each of said resonator cavities having an in-line coupler for coupling said electromagnetic signal between a said resonator of one said cavity and a resonator of a subsequent directly adjacent said cavity;

a cross-coupler disposed between a first said cavity and a second said cavity of said cavities, said first cavity being non-sequential to said second cavity, said cross-coupler providing cross-coupling of an electromagnetic field of said electromagnetic signal between said first cavity and said second cavity, said cross-coupler including a printed circuit board;

said printed circuit board including a compression board, said compression board being constructed of a dielectric material;

said printed circuit board comprising a dielectric layer and an electrically conductive layer, a significant portion of said electrically conductive layer being located between said compression board and said dielectric layer.

2. The tunable, cross-coupled, bandpass filter as defined in claim 1 wherein:

said electrically conductive layer forming edge layers located exteriorly of said significant portion and are exposed, each said edge layer substantially covers a longitudinal end of said dielectric layer and are not located between said compression board and said dielectric layer, each said edge layer to be in close proximity to a said resonator but spaced therefrom.

3. The tunable, cross-coupled, bandpass filter as defined in claim 1 wherein:

a screw arrangement passing through holes in said printed circuit board, said screw arrangement being manually adjustable in order to change the inductance of said electromagnetic field of said electromagnetic signal, said screw arrangement being in contact with said electrically conducting layers to interrupt said electromagnetic field passing through said electrically conductive layer in order to change the overall susceptance of the electromagnetic field that is being conducted through said filter.

4. A cross-coupled bandpass filter for a microwave electromagnetic signal comprising:

a housing which has a plurality of sequential resonator cavities, said cavities being coupled by in-line couplers;

a resonator mounted within each of said cavities; and a cross-coupler disposed between a first cavity and a second cavity of said cavities, said first cavity being non-sequential to said second cavity, said cross-coupler being fixedly mounted to said housing, said cross-coupler providing cross-coupling of the electromagnetic signal between said first cavity and said second cavity, a first portion of said cross-coupler being located within said first cavity and a second portion of said cross-coupler being located within said second cavity, said cross-coupler having mounted thereon a first tuning screw which is manually tunable relative to said cross-coupler, said cross-coupler being formed of a pair of dielectric layers which are separated by an electrically conductive layer, moving of said first tuning screw causes the susceptance of said electromagnetic signal to vary as said first tuning screw is in contact with said electrically conductive layer.

5. The cross-coupled bandpass filter as defined in claim 4 wherein:

said electrically conductive layer having exposed edge layers which are not located between said dielectric layers, each said edge layer to be in close proximity to a said resonator but spaced therefrom.

6. The cross-coupled bandpass filter as defined in claim 4 wherein:

a second tuning screw located spaced apart from said first tuning screw with said first tuning screw being mounted within said first cavity and said second tuning screw being mounted within said second cavity, said second tuning screw being mounted within said cross-coupler and also in contact with said electrically conductive layer.

* * * * *